US011312033B2

(12) United States Patent
Ohara et al.

(10) Patent No.: US 11,312,033 B2
(45) Date of Patent: Apr. 26, 2022

(54) ROTARY ELECTRIC SHAVER

(71) Applicant: Maxell Izumi Co., Ltd., Matsumoto (JP)

(72) Inventors: Toshihiko Ohara, Matsumoto (JP); Tomio Kozu, Matsumoto (JP)

(73) Assignee: MAXELL IZUMI CO., LTD., Matsumoto (JP)

( * ) Notice: Subject to any disclaimer, the term of this patent is extended or adjusted under 35 U.S.C. 154(b) by 64 days.

(21) Appl. No.: 17/007,217

(22) Filed: Aug. 31, 2020

(65) Prior Publication Data

US 2021/0122069 A1 Apr. 29, 2021

(30) Foreign Application Priority Data

Oct. 24, 2019 (JP) ..... JP2019-193166

(51) Int. Cl.

| | |
|---|---|
| ***B26B 19/38*** | (2006.01) |
| ***B26B 19/04*** | (2006.01) |
| ***B26B 19/14*** | (2006.01) |
| ***B26B 19/28*** | (2006.01) |

(52) U.S. Cl.

CPC ..... *B26B 19/386* (2013.01); *B26B 19/046* (2013.01); *B26B 19/145* (2013.01); *B26B 19/288* (2013.01)

(58) Field of Classification Search

CPC ..... B26B 19/38; B26B 19/04; B26B 19/14; B26B 19/28; B26B 19/386; B26B 19/288; B26B 19/046; B26B 19/145; B26B 19/3813

USPC ..... 30/43.7–43.92

See application file for complete search history.

(56) References Cited

U.S. PATENT DOCUMENTS

| | | | | |
|---|---|---|---|---|
| 6,378,210 | B1 * | 4/2002 | Bickford | B26B 19/3806 30/122 |
| 7,114,257 | B1 * | 10/2006 | Ortega | A61C 17/32 30/43.92 |
| 10,195,751 | B2 * | 2/2019 | Shimizu | B26B 19/146 |
| 2017/0008179 | A1 * | 1/2017 | Shimizu | B26B 19/36 |
| 2018/0281213 | A1 * | 10/2018 | Eijkelkamp | B26B 19/386 |

FOREIGN PATENT DOCUMENTS

JP 6200918 B2 9/2017

* cited by examiner

*Primary Examiner* — Kenneth E Peterson
*Assistant Examiner* — Nhat Chieu Q Do
(74) *Attorney, Agent, or Firm* — Manabu Kanesaka

(57) ABSTRACT

A rotary electric shaver has a new structure which compatibly achieves both a function of the rotary electric shaver allowing a user to have less tingling feel on the skin and a function of a reciprocating electric shaver enabling easy deep shaving of hair, by replacing a first head. A rotary electric shaver includes a main body having a drive shaft and a connection part, a first head having a built-in first transmission drive system connected to the drive shaft to rotate a first inner blade, and detachably connected to the connection part, and a second head detachably connected to the connection part from which the first head is removed. The second head has a built-in second transmission drive system connected to the drive shaft to cause the second inner blade to reciprocate.

6 Claims, 9 Drawing Sheets

ROTARY ELECTRIC SHAVER

CROSS-REFERENCE TO RELATED APPLICATION

This application is based upon and claims the benefit of priority of the prior Japanese Patent Application No. P2019-193166, filed on Oct. 24, 2019, and the entire contents of which are incorporated herein by reference.

TECHNICAL FIELD

The present invention relates to a rotary electric shaver.

BACKGROUND ART

An electric shaver is mainly classified into a rotary electric shaver having a structure in which an inner blade rotates, and a reciprocating electric shaver having a structure in which an inner blade reciprocates. A known rotary electric shaver includes a main body having a built-in motor, and a head having a plurality of blade units having an outer blade having a circular shaving surface on an outer side and an inner blade rotating while coming into sliding contact with an inner surface of the outer blade, and is configured so that the head is set in the main body.

In the related art, a configuration is known as follows. The head having the structure in which the inner blade rotates is detachably connected to the main body (PTL 1: Japanese Patent No. 6200918).

CITATION LIST

SUMMARY OF INVENTION

Technical Problem

An outer blade of a rotary electric shaver is thicker than an outer blade of a reciprocating electric shaver. Accordingly, contact between a skin and an inner blade is suppressed, thereby allowing a user to have less tingling feel on the skin. On the other hand, the outer blade of the reciprocating electric shaver is thinner than the outer blade of the rotary electric shaver. Accordingly, the reciprocating electric shaver enables easy deep shaving of hair. Due to a structure of the outer blade, it is difficult to compatibly achieve both less tingling feel on the skin and deep shaving of the hair. Therefore, as an example, it is conceivable to adopt a method of using both the rotary electric shaver and the reciprocating electric shaver. However, in a case of using both the rotary electric shaver and the reciprocating electric shaver, a weight and a size are increased as a whole. Consequently, component cost and manufacturing cost are increased, thereby causing a disadvantage in that usability is poor.

Therefore, it is conceivable to adopt a configuration in which a head of a commercially available reciprocating electric shaver is combined with a technique in the related art disclosed in PTL 1. However, the rotary electric shaver has a configuration in which a drive shaft is rotated 2,000 to 4,000 times per minute to rotate the inner blade. In contrast, the reciprocating electric shaver has a configuration in which the drive shaft is rotated 6,000 to 10,000 per minute. Moreover, a rotational motion is converted into a reciprocating motion by an oscillator to cause the inner blade to reciprocate. In this regard, there is a big structural difference between the rotary electric shaver and the reciprocating electric shaver. That is, both the electric shavers are greatly different rotation speeds of drive systems. Therefore, if the reciprocating electric shaver uses to be driven by the drive shaft of the rotary electric shaver, the rotation speed is insufficient, thereby causing a new disadvantage in that the hair is less likely to be cut.

Solution to Problem

In response to the above issue, one or more aspects of the present invention are directed to a rotary electric shaver having a new structure which compatibly achieves both a function of the rotary electric shaver allowing a user to have less tingling feel on the skin and a function of a reciprocating electric shaver enabling easy deep shaving of hair, by replacing a first head while one main body is used. In this invention, examples of the hairs include beards, mustache, whisker, and the like.

The present invention has been accomplished under the solutions as disclosed below.

According to the present invention, there is provided a rotary electric shaver including a main body having a drive shaft and a connection part, a first head having a plurality of first blade units having a first outer blade, a first inner blade rotating while coming into sliding contact with an inner surface of the first outer blade, and a first driven shaft that rotates the first inner blade, having a built-in first transmission drive system connected to the drive shaft to rotate the first driven shaft, and detachably connected to the connection part, and a second head detachably connected to the connection part from which the first head is removed. The second head has a plurality of second blade units having a second outer blade and a second inner blade reciprocating while coming into sliding contact with an inner surface of the second outer blade, and having a built-in second transmission drive system connected to the drive shaft to cause the second inner blade to reciprocate. The second transmission drive system has an eccentric shaft and a plurality of oscillators that convert a rotational motion of the eccentric shaft into a reciprocating motion, and rotates the eccentric shaft at a rotation speed higher than a rotation speed of the first driven shaft.

According to this configuration, when the first head is connected to the main body, the electric shaver is operated as the rotary electric shaver. When the second head is connected to the main body from which the first head is removed, the electric shaver is operated as the reciprocating electric shaver. Therefore, one main body can compatibly achieve both a function of the rotary electric shaver allowing a user to have less tingling feel on the skin and a function of the reciprocating electric shaver enabling easy deep shaving of the hair. The main body can maintain a current size and a current configuration. Accordingly, while an increase in a weight or a size is suppressed as a whole, component cost and manufacturing cost are minimized, thereby allowing satisfactory usability.

Advantageous Effects of Invention

According to the present invention, it is possible to realize the rotary electric shaver having a new structure which compatibly achieve both the function of the rotary electric shaver allowing a user to have less tingling feel on the skin and the function of the reciprocating electric shaver enabling easy deep shaving of the hair, by replacing the first head while one main body is used.

DESCRIPTION OF EMBODIMENTS

Figure 1:
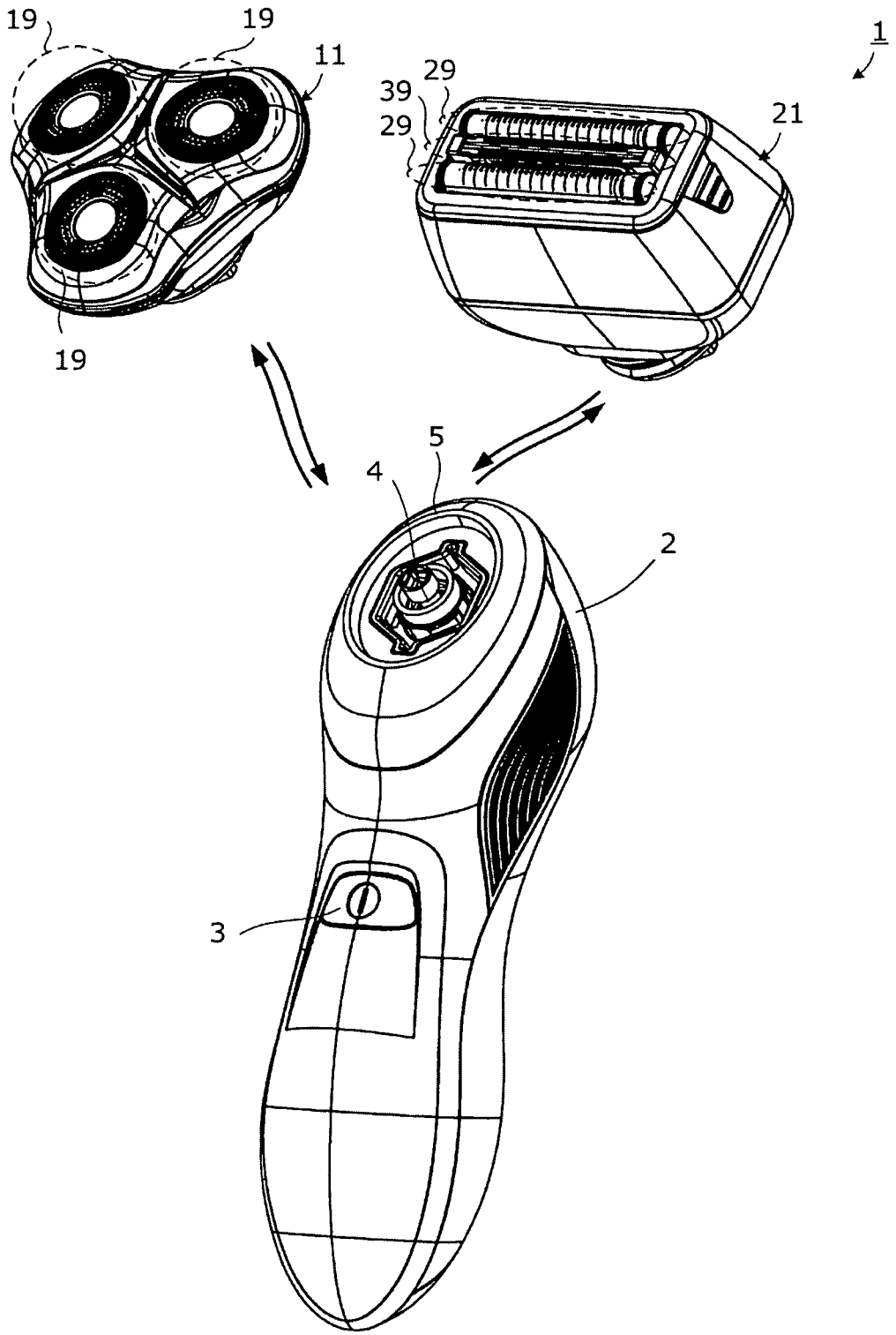
FIG. 1 is a view illustrating an example of a rotary electric shaver according to an embodiment of the present invention, and is a schematic perspective view illustrating a state where a first head and a second head are removed from a main body.
Figure 2:
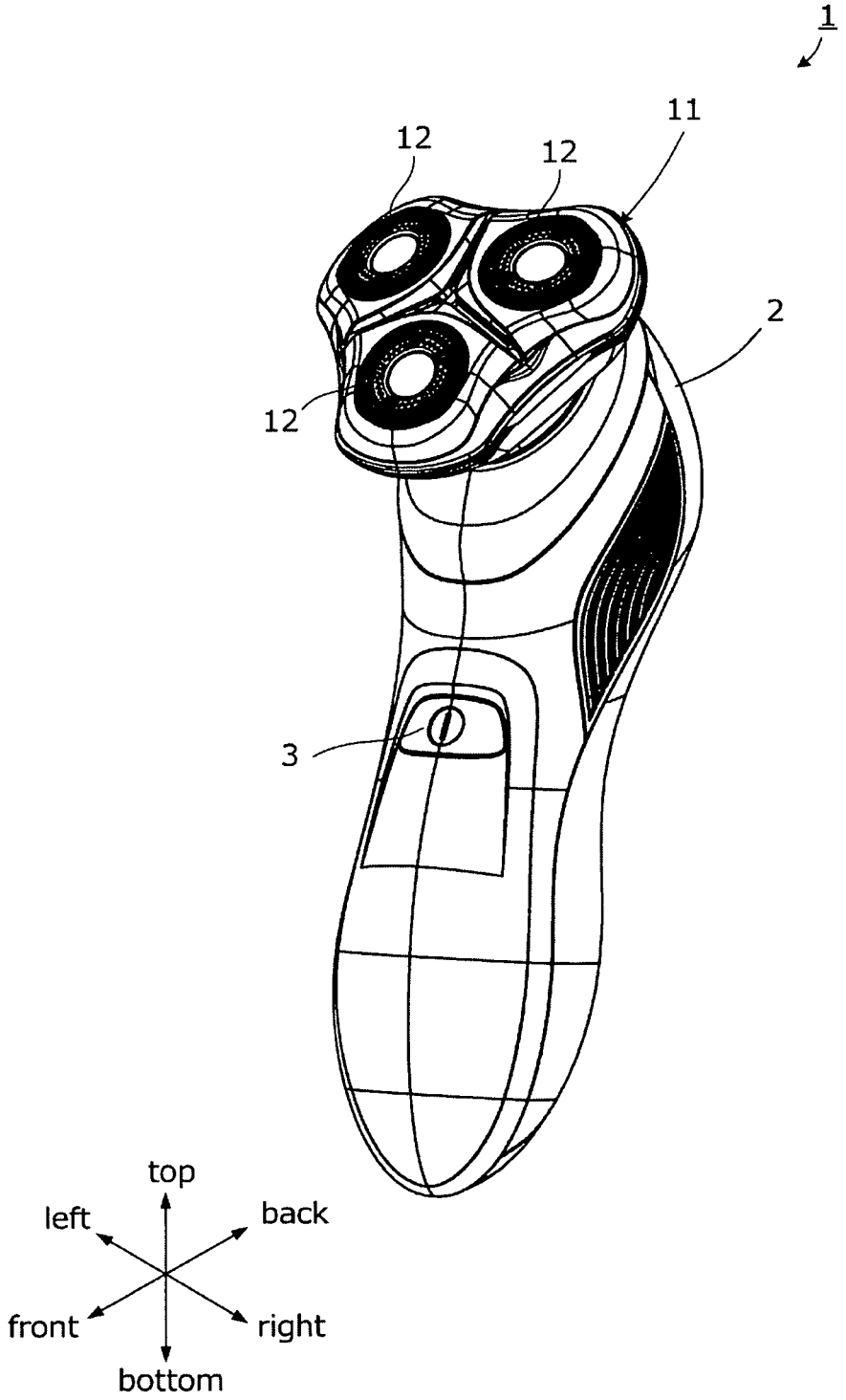
FIG. 2 is a schematic perspective view illustrating a state where the first head is set in the main body in FIG. 1.
Figure 3:
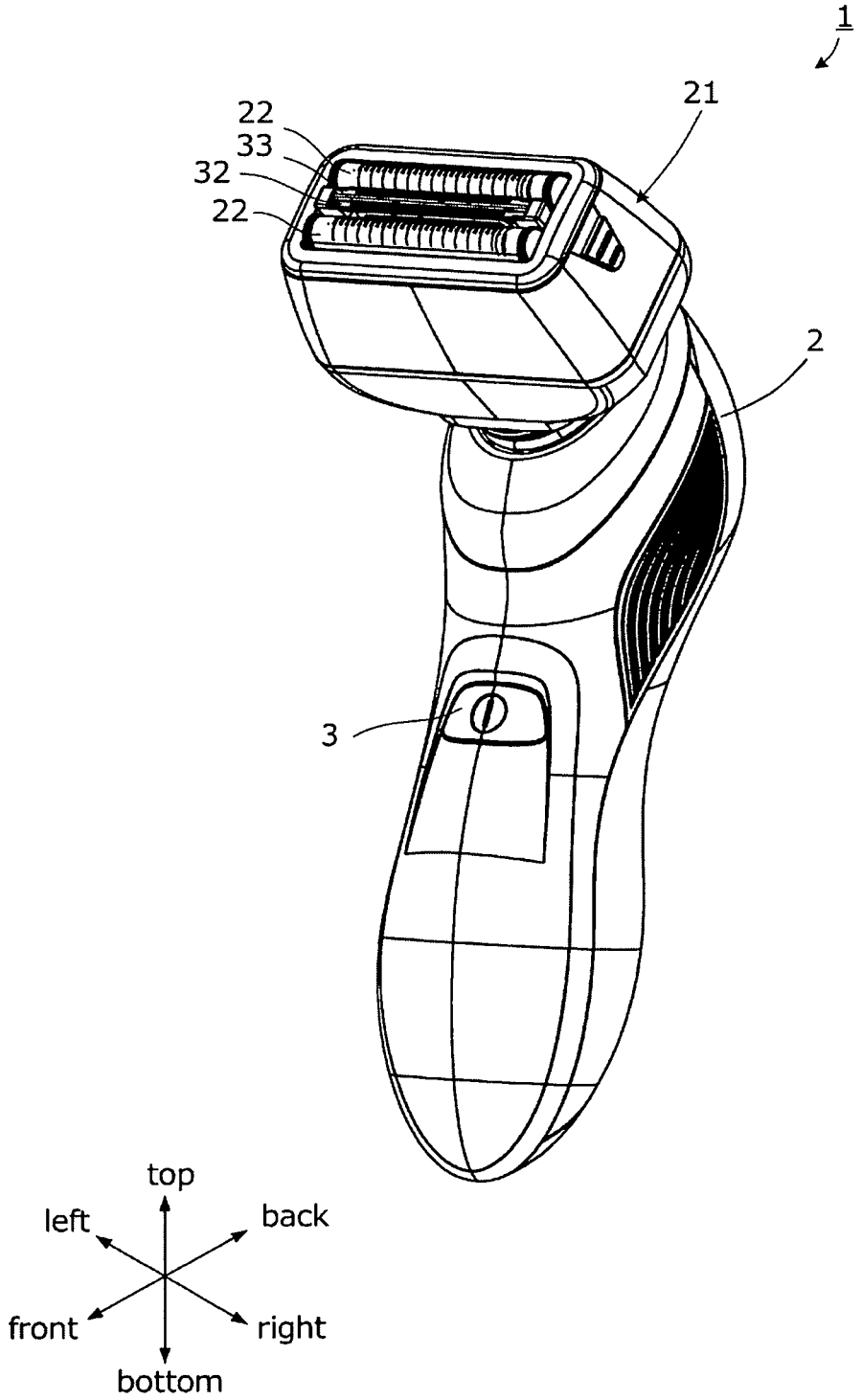
FIG. 3 is a schematic perspective view illustrating a state where the second head is set in the main body in FIG. 1.

Hereinafter, an embodiment according to the present invention will be described in detail with reference to the drawings. In the present embodiment, as an example, a rotary electric shaver 1 has a first head 11 having a plurality of first blade units 19, and a second head 21 having a plurality of second blade units 29 and a third blade unit 39. Hereinafter, in some cases, the rotary electric shaver 1 may be simply referred to as an "electric shaver". In all the drawings for describing the embodiment, the same reference numerals will be assigned to members having the same function, and repeated description thereof may be omitted in some cases.

As illustrated in FIG. 1, as an example, the electric shaver 1 includes a main body 2 held by a user, the first head 11 detachably connected to a connection part 5 disposed in the main body 2, and the second head 21 detachably connected to the connection part 5 in the main body 2 from which the first head 11 is removed. In FIG. 1, the first blade unit 19, the second blade unit 29, and the third blade unit 39 are illustrated by areas respectively surrounded by broken lines.

A front surface side of the main body 2 is an operation panel, and a power switch 3 is disposed thereon as an example. The main body 2 has a motor, a power supply unit that supplies electricity to the motor, and a built-in control unit (not illustrated) that controls the motor and the power supply unit, and a technique in the related art is applicable to the main body 2.

The first head 11 includes a plurality of first blade units 19 having a cap-shaped first outer blade 12 having a circular shaving surface on an outer side, a first outer blade setting part 55 that sets the first outer blade 12, a first inner blade 13 rotating while coming into sliding contact with an inner surface of the first outer blade 12, and a first driven shaft 14 that rotates the first inner blade 13. In the present embodiment, three first blade units 19 are disposed at an equal interval in a circumferential direction around a center of the first head 11 in a plan view. In addition, the first head 11 has a first blade frame 15 that holds the first blade unit 19 to be capable of swing movement, and a first blade setting base 17 that holds the first blade frame 15. Without being limited to the above-described configuration, in some cases, two first blade units 19 may be disposed at the equal interval in the circumferential direction around the center of the first head 11 in a plan view.

Figure 4:
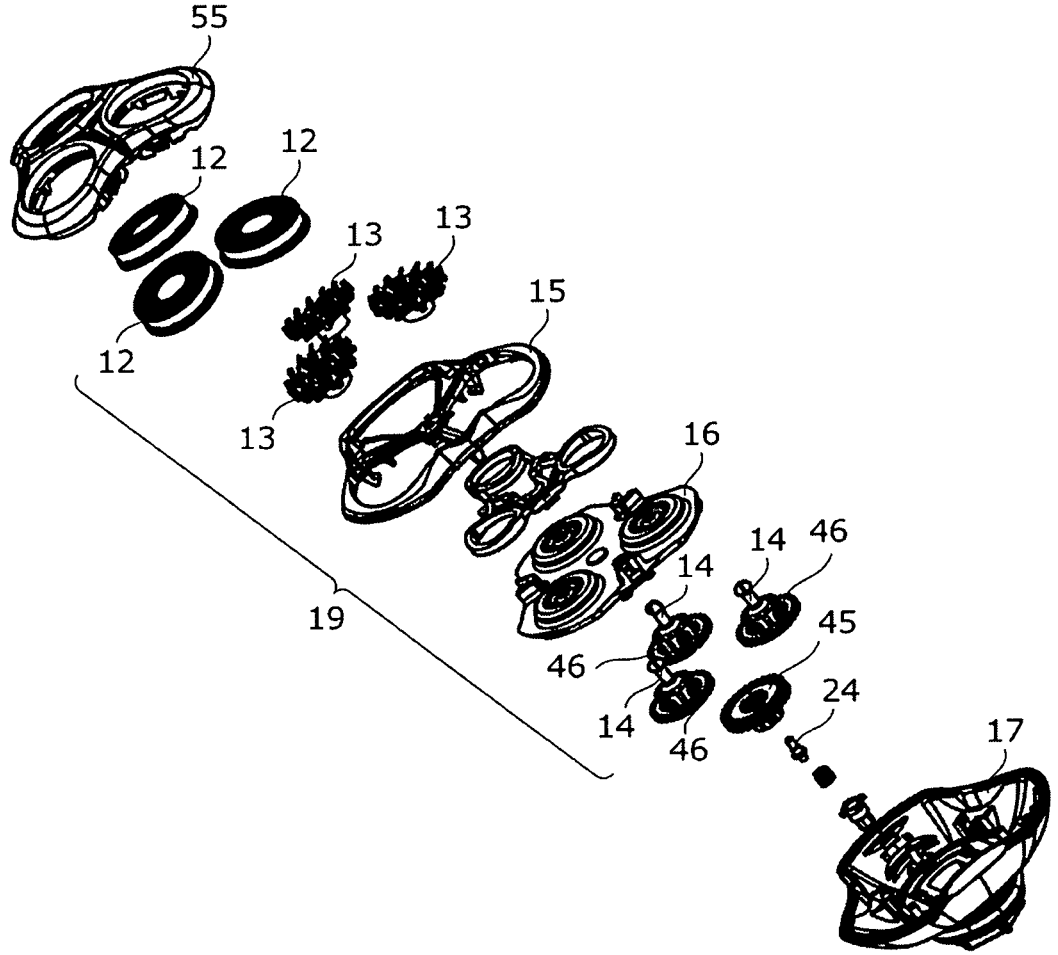
FIG. 4 is a schematic structural development view of the first head.
Figure 5A:
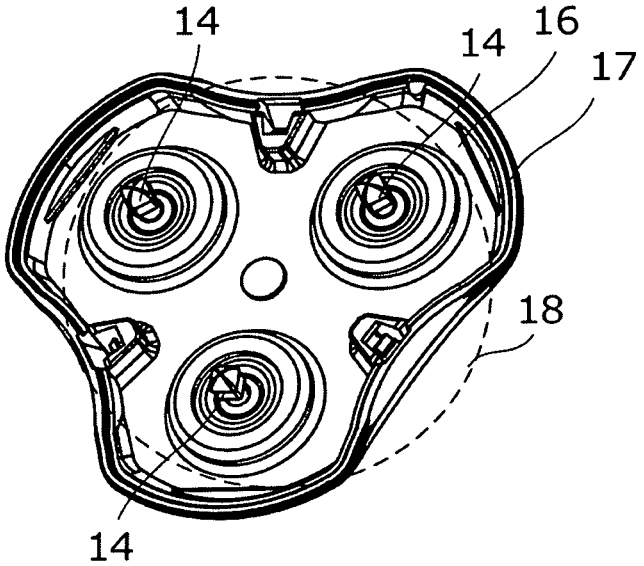
FIG. 5A is a view illustrating a main part of a first transmission drive system in the first head.
Figure 5B:
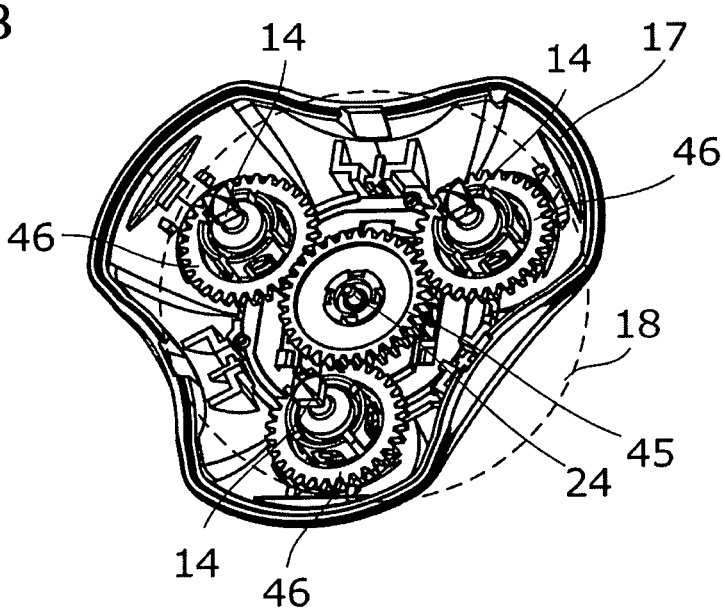
FIG. 5B is a view illustrating a state where a diaphragm in FIG. 5A is removed.

FIG. 4 is a schematic structural development view of the first head 11. FIG. 5A is a view illustrating a main part of a first transmission drive system 18 in the first head 11. FIG. 5B is a view illustrating a state where a diaphragm 16 in FIG. 5A is removed. As illustrated in FIGS. 5A and 5B, the first head 11 has the built-in first transmission drive system 18 adopting a gear drive type that transmits driving power of a drive shaft 4 to rotate the first driven shaft 14. The first transmission drive system 18 has a gear fulcrum shaft 24, a third gear 45 rotated by the gear fulcrum shaft 24, a plurality of fourth gears 46 rotated by meshing with the third gear 45, and the first driven shaft 14 assembled to the fourth gear 46. As an example, in a state where the first transmission drive system 18 is connected to the drive shaft 4, the drive shaft 4, the gear fulcrum shaft 24, and the first driven shaft 14 are set to have the same rotation speed. As an example, the rotation speed of the first driven shaft 14 is set within a range of 0.75 times to 1.25 times, based on the rotation speed of the drive shaft 4. A known technique is applicable to the first transmission drive system 18.

As an example, the second head 21 has a plurality of second blade units 29 having a second outer blade 22 and a second inner blade 23 that reciprocates while coming into sliding contact with an inner surface of the second outer blade 22. In addition, the second head 21 has a third blade unit 39 having a third outer blade 32 and a third inner blade 33 that reciprocates while coming into sliding contact with an inner surface of the third outer blade 32. In the present embodiment, the third blade unit 39 is disposed at a position between the second blade unit 29 and the second blade unit 29. Without being limited to the above-described configuration, in some cases, one second blade unit 29 may be provided.

The second head 21 has an outer blade holding frame in which the second outer blade 22 is set to be able to follow an ascending-descending operation of the second inner blade 23, a second blade frame 25 in which the outer blade holding frame is set, and a second blade setting base 27 that holds the second blade frame 25. As an example, the second outer blade 22 adopts a configuration in which a metal plate having fine holes is set in a resin frame by being formed into an inverted U-shaped cross section. As an example, the third outer blade 32 adopts a configuration in which a pair of front and rear metal plates having one side processed into a comb shape is set in the resin frame. The second inner blade 23 has an inverted U-shaped cross section corresponding to the second outer blade 22. The third inner blade 33 has an inverted L-shaped cross section corresponding to the third outer blade 32, and has a shape symmetrically disposed in a forward-rearward direction. As an example, in a state of being pressed by a coil spring, the second inner blade 23 reciprocates in a longitudinal direction of the second outer blade 22 while coming into sliding contact with an inner surface of the second outer blade 22. The third inner blade 33 is set inside the third outer blade 32, and reciprocates in the longitudinal direction of the third outer blade 32 while coming into sliding contact with the inner surface of the third outer blade 32. The second outer blade 22 and the second inner blade 23 are wide-angle cutting blades, and have an arch-shaped cross section. The third outer blade 32 and the third inner blade 33 are trimmer blades, and have a T-shaped cross section. Any desired configuration ratio between the wide-angle cutting blades and the trimmer blades in the second head 21 may be adopted. A known technique is applicable to the second outer blade 22 and the second inner blade 23, and the third outer blade 32 and the third inner blade 33.

An oscillator 31*a* and an oscillator 31*b* respectively have movable stands 61*a*, 61*b* capable of reciprocating, support parts 62*a*, 62*b* disposed in both ends of the movable stands 61*a*, 61*b* to hang the movable stands, setting parts 63*a*, 63*b* disposed in both ends of the support parts 62*a*, 62*b* to be set in the second head 21, and arm parts 64*a*, 64*b* erected from and fixed to the movable stands 61*a*, 61*b*, and upper end parts 65*a*, 65*b* of the arm parts 64*a*, 64*b* are detachably set in the second inner blade 23. In the present embodiment, the oscillator 31*a* and the oscillator 31*b* are disposed in a forward-rearward direction. A known technique is applicable to the oscillator 31*a* and the oscillator 31*b*. Without being limited to the above-described configuration, in some cases, one oscillator 31*a* or one oscillator 31*b* may be provided.

Figure 6:
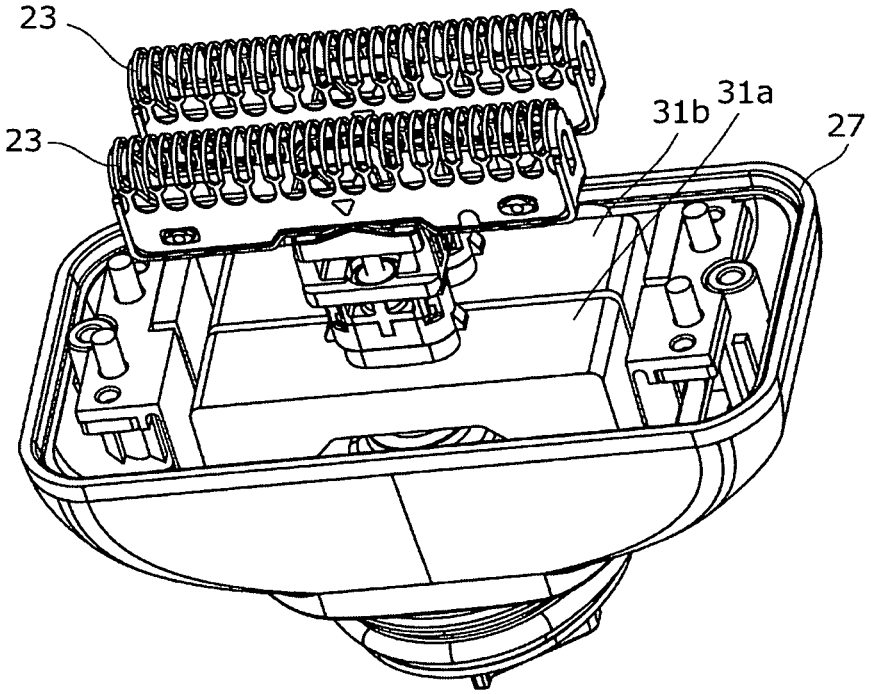
FIG. 6 is a schematic view illustrating a configuration of disposing a second inner blade in the second head.
Figure 7A:
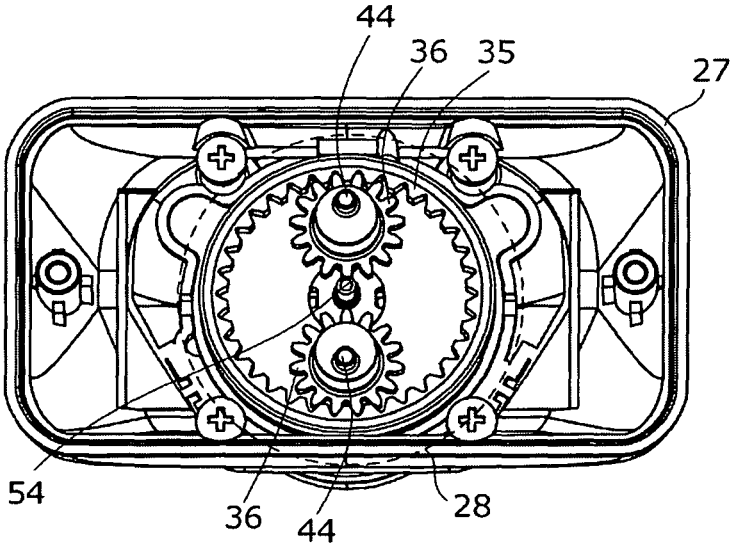
FIG. 7A is a view illustrating a main part of a second transmission drive system in the second head.
Figure 7B:
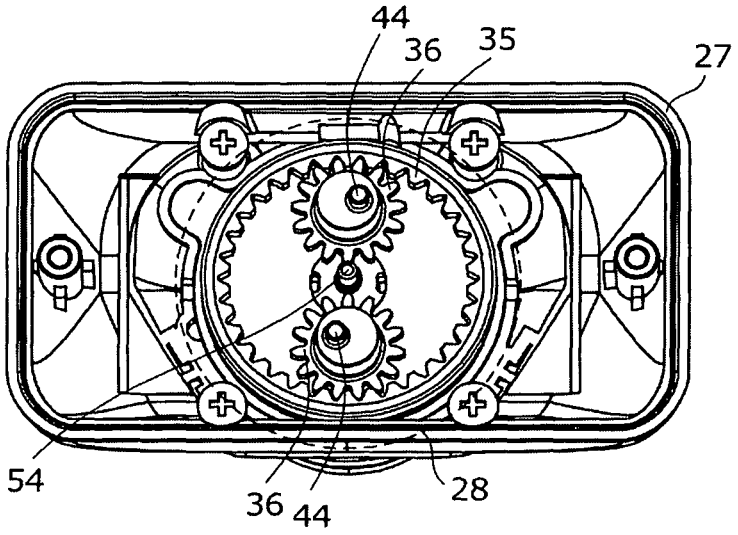
FIG. 7B is a view illustrating a state where a first gear in FIG. 7A is rotated as much as a predetermined amount.
Figure 8:
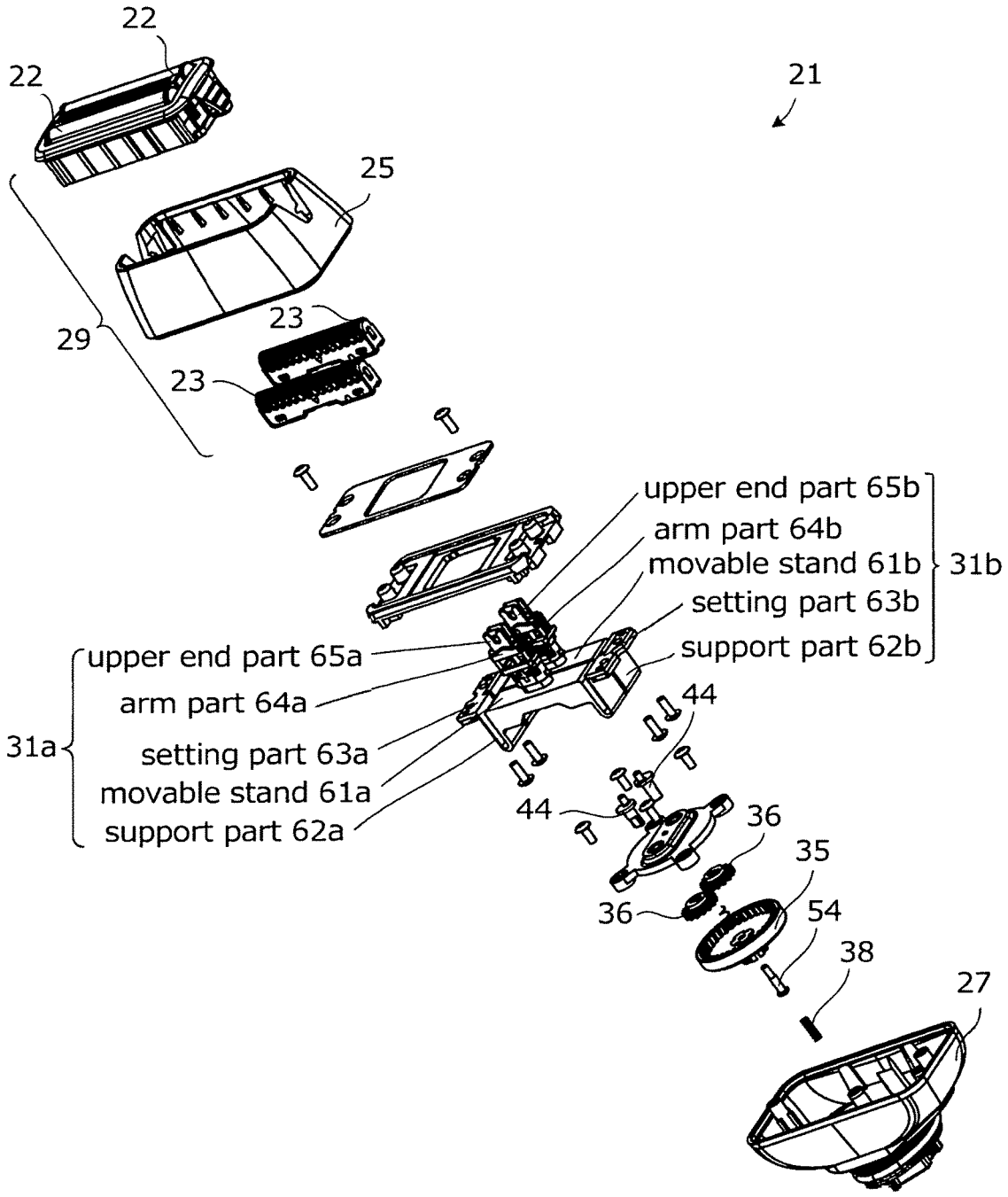
FIG. 8 is a schematic structural development view of the second head.

FIG. 6 is a schematic view illustrating a configuration of disposing the second inner blade 23 in the second head 21. FIG. 7A is a view illustrating a main part of a second transmission drive system 28 in the second head 21. FIG. 7B is a view illustrating a state where the first gear 35 in FIG. 7A is rotated as much as a predetermined amount. As illustrated in FIGS. 7A and 7B, the second head 21 has the built-in second transmission drive system 28 adopting a gear drive type that transmits the driving power of the drive shaft 4 to rotate the eccentric shaft 44. In the present embodiment, two eccentric shafts 44 are provided, and are respectively connected to the oscillator 31*a* and the oscillator 31*b*. Without being limited to the above-described configuration, in some cases, one eccentric shaft 44 may be provided.

The second transmission drive system 28 has the first gear 35, the second gear 36 rotated by meshing with the first gear 35, and the eccentric shaft 44 assembled to the second gear 36. In the present embodiment, the oscillator 31*a* and the oscillator 31*b* are disposed to reciprocate in opposite directions. In this manner, in the oscillator 31*a* and the oscillator 31*b*, vibrations generated by the reciprocating motions are mutually cancelled. Accordingly, low vibration and low noise can be achieved. Then, in the example in FIGS. 7A and 7B, the first gear 35 is an internal gear, and the second gear 36 is an external gear. In addition, two combinations of the second gear 36 and the eccentric shaft 44 are disposed, and the eccentric shaft 44 is disposed at 180° rotationally symmetrically with respect to the gear fulcrum shaft 54. In this manner, the oscillator 31*a* and the oscillator 31*b* can reciprocate with highest efficiency by using a combination of minimum required gears. Without being limited to the above-described configuration, in some cases, a plurality of the second gears 36 may be disposed rotationally symmetrically with respect to the gear fulcrum shaft 54 within a range of 90 degrees to 180 degrees.

In the present embodiment, the second transmission drive system 28 is configured to rotate the eccentric shaft 44 at a rotation speed higher than a rotation speed of the first driven shaft 14. As an example, the rotation speed of the second gear 36 is set to be at least twice the rotation speed of the first gear 35. That is, as an example, the first head 11 is connected to the main body 2, the first transmission drive system 18 is in a state of being connected to the drive shaft 4. In a case where the first inner blade 13 is operated and rotated 4,000 times per minute, when the second head 21 is connected to the main body 2 from which the first head 11 is removed and the second transmission drive system 28 is connected to the drive shaft 4, the second inner blade 23 can reciprocate at a high speed to reach 8,000 strokes or more per minute.

Figure 9:
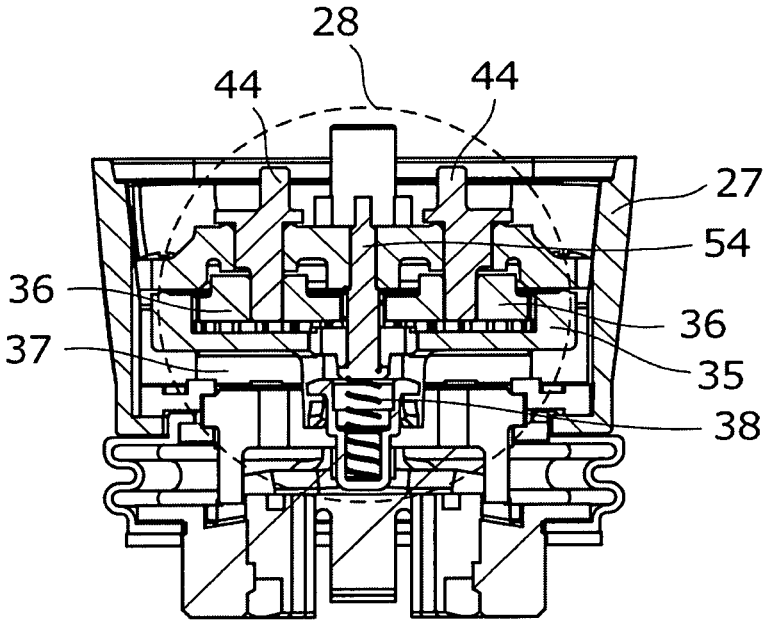
FIG. 9 is a sectional view illustrating a main part of the second transmission drive system in the second head.

FIG. 9 is a sectional view illustrating a main part of the second transmission drive system 28 in the second head 21. In the present embodiment, a compression coil spring 38 is disposed as a pressing member that presses up the gear fulcrum shaft 54. According to this configuration, the first gear 35 and the gear fixing part 37 can be brought into a non-contact state in an upward-downward direction. Accordingly, low vibration and low noise can be achieved.

The present invention is not limited to the embodiments described above, and various modifications can be made within the scope not departing from the present invention.

What is claimed is:

1. A rotary electric shaver with a kit, comprising:

a main body having a drive shaft and a connection part;

a first head having a plurality of first blade units each having a first outer blade, a first inner blade rotating while coming into sliding contact with an inner surface of the first outer blade, and a first driven shaft that rotates the first inner blade, wherein the first head has a built-in first transmission drive system connected to the drive shaft to rotate the first driven shaft, and detachably connected to the connection part; and a second head detachably connected to the connection part from which the first head is removed, wherein the second head has a plurality of second blade units each having a second outer blade and a second inner blade reciprocating while coming into sliding contact with an inner surface of the second outer blade, and wherein the second head has a built-in second transmission drive system connected to the drive shaft to cause the second inner blade to reciprocate, and wherein the second transmission drive system has an eccentric shaft and a plurality of oscillators that convert a rotational motion of the eccentric shaft into a reciprocating motion, and rotates the eccentric shaft at a rotation speed higher than a rotation speed of the first driven shaft, wherein the second transmission drive system has a first gear rotated by driving power of the drive shaft and a second gear rotated by meshing with the first gear, and the eccentric shaft is assembled to the second gear, and wherein the rotation speed of the second gear is set to be at least twice the rotation speed of the first gear.

2. The rotary electric shaver with the kit according to claim 1, wherein the first gear is an internal gear, and the second gear is an external gear.

3. The rotary electric shaver with the kit according to claim 2, wherein two of the oscillators in total are disposed to reciprocate in opposite directions.

4. The rotary electric shaver according to claim 1, wherein two of the oscillators in total are disposed to reciprocate in opposite directions.

5. The rotary electric shaver with the kit according to claim 1, wherein the first head further has a first blade frame that holds each of the first blade units to be capable of swing movement, and a first blade setting base that holds the first blade frame, and the first blade setting base is connected to the main body to be capable of tilting, and wherein the first blade units are disposed at an equal interval in a circumferential direction around a center of the first head in a plan view.

6. The rotary electric shaver with the kit according to claim 1, wherein the second head further has a second blade frame that holds each of the second blade units to be capable of swing movement, and a second blade setting base that holds the second blade frame, and the second blade setting base is connected to the main body to be capable of tilting, wherein the second inner blade has an inverted U-shaped cross section corresponding to the second outer blade, and wherein the oscillators have movable stands capable of reciprocating, support parts disposed in both ends of the movable stands to hang the movable stands, setting parts respectively disposed in the support parts to be set in the second head, and arm parts erected from and fixed to the movable stands, and an upper end part is detachably set in the second inner blade.

* * * * *